US007703481B2

(12) United States Patent
Taipale et al.

(10) Patent No.: US 7,703,481 B2
(45) Date of Patent: Apr. 27, 2010

(54) PAPER MACHINE FABRIC

(75) Inventors: Seppo Taipale, Siilinjarvi (FI); Mari Seppanen, Juankoski (FI); Terttu Turpeinen, Juankoski (FI); Pekka Kortelainen, Juankoski (FI)

(73) Assignee: Tamfelt PMC OY, Tampere (FI)

( * ) Notice: Subject to any disclaimer, the term of this patent is extended or adjusted under 35 U.S.C. 154(b) by 90 days.

(21) Appl. No.: 11/992,009

(22) PCT Filed: Oct. 5, 2006

(86) PCT No.: PCT/FI2006/050429

§ 371 (c)(1),
(2), (4) Date: Mar. 14, 2008

(87) PCT Pub. No.: WO2007/039672

PCT Pub. Date: Apr. 12, 2007

(65) Prior Publication Data

US 2008/0308171 A1 Dec. 18, 2008

(30) Foreign Application Priority Data

Oct. 6, 2005 (FI) ..... 20055537

(51) Int. Cl.

| | |
|---|---|
| ***D21F 1/10*** | (2006.01) |
| ***D21F 7/08*** | (2006.01) |
| ***D03D 3/04*** | (2006.01) |
| *D03D 25/00* | (2006.01) |

(52) U.S. Cl. ..... 139/383 A; 139/383 R; 139/383 AA; 162/358.2

(58) Field of Classification Search ..... 139/383 R, 139/383 A, 383 AA, 408, 411, 412, 413, 139/414; 162/348, 358.1, 358.2, 900, 902, 162/903, 904

See application file for complete search history.

(56) References Cited

U.S. PATENT DOCUMENTS

| | | | | |
|---|---|---|---|---|
| 4,041,989 | A | 8/1977 | Johansson et al. | |
| 4,501,303 | A | 2/1985 | Osterberg | |
| 5,006,399 | A * | 4/1991 | Salminen et al. | 442/189 |
| 5,826,627 | A | 10/1998 | Seabrook et al. | |
| 5,967,195 | A | 10/1999 | Ward | |
| 6,354,335 | B1 * | 3/2002 | Taipale et al. | 139/383 A |
| 6,533,901 | B2 * | 3/2003 | Taipale | 162/348 |
| 7,001,489 | B2 * | 2/2006 | Taipale et al. | 162/348 |

(Continued)

FOREIGN PATENT DOCUMENTS

EP 1 365 066 A1 11/2003

(Continued)

*Primary Examiner*—Bobby H Muromoto, Jr.
(74) *Attorney, Agent, or Firm*—Oliff & Berridge, PLC

(57) ABSTRACT

A paper machine fabric having at least two separate layers made of at least four warp yarn systems woven in different manners and a weft yarn system woven in at least two different manners. The layers are bound together by a binder warp system, whereby the binder warp is arranged to complement the surface of the paper side and to be interwoven with the layer of the machine side by being interwoven under at least one weft yarn of the machine side. The warp yarns of one warp yarn system, i.e. wandering warps, are arranged to complement a warp path formed by the binder warps so that it is continuous at those points on the machine side where the binder warps constitute a part of the paper side structure.

16 Claims, 4 Drawing Sheets

U.S. PATENT DOCUMENTS

Figure 1:
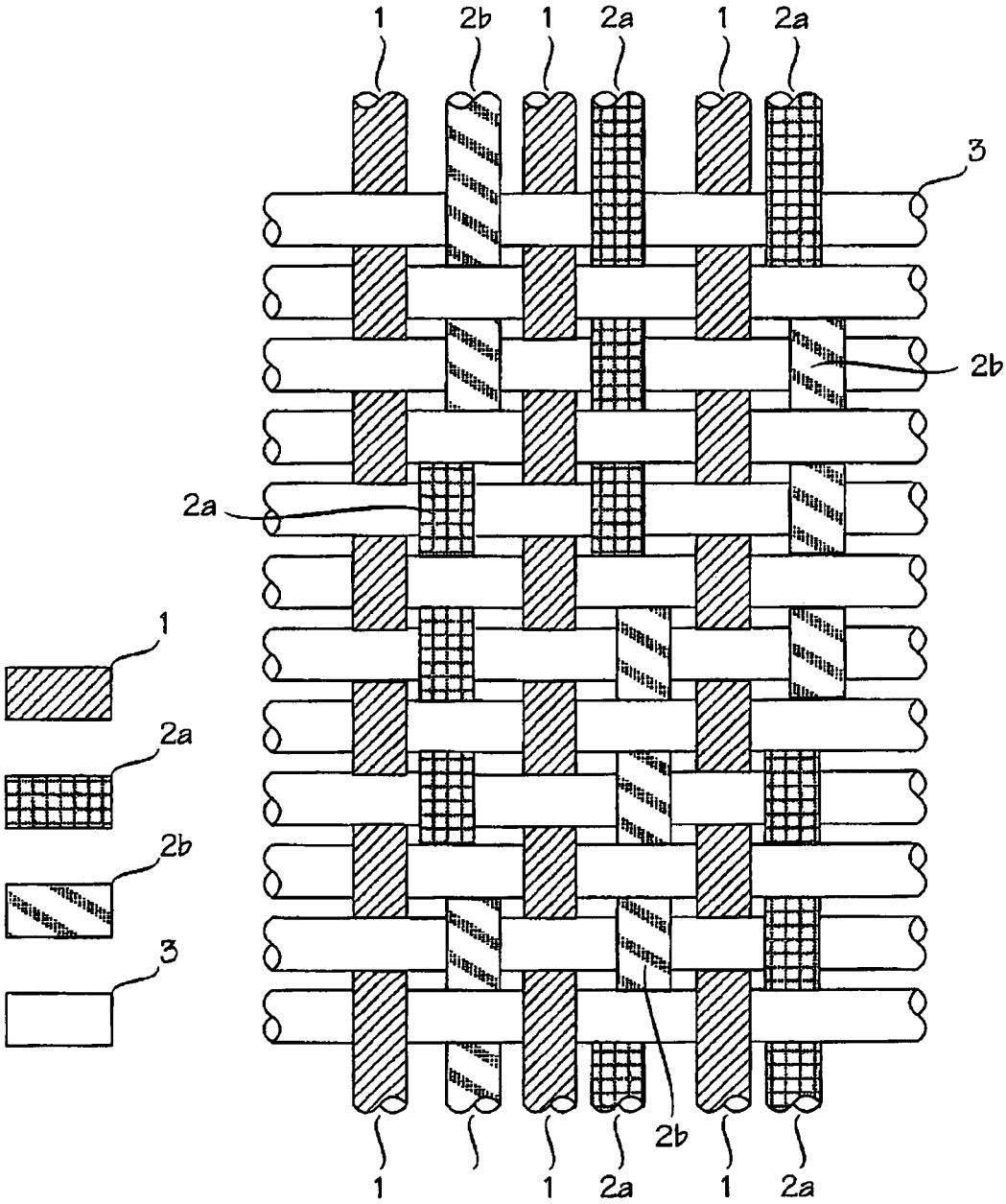

| | | | | |
|---|---|---|---|---|
| 7,507,679 | B2 * | 3/2009 | Taipale et al. | 442/194 |
| 2002/0060039 | A1 * | 5/2002 | Taipale | 162/348 |
| 2004/0003860 | A1 * | 1/2004 | Taipale et al. | 139/383 A |
| 2004/0182465 | A1 | 9/2004 | Ward | |
| 2005/0121097 | A1 | 6/2005 | Ward | |
| 2009/0159148 | A1 * | 6/2009 | Enqvist et al. | 139/383 AA |

FOREIGN PATENT DOCUMENTS

| | | | |
|---|---|---|---|
| GB | 2 022 638 | A | 12/1979 |
| WO | WO 2006/015377 | A2 | 2/2006 |

* cited by examiner

PAPER MACHINE FABRIC

The invention relates to a paper machine fabric comprising at least two separate layers made of at least four warp yarn systems woven in different manners and a weft yarn system woven in at least two different manners, the layers being bound together by means of a binder warp system, whereby the binder warp is arranged to complement the surface of the paper side and to be interwoven with the layer of the machine side by being inter-woven under at least one weft yarn of the machine side.

Formation of a paper web begins in a wire section where most of the water is removed. As pulp is spread on a wet wire, it contains approximately 99% of water, the rest being fibres and possible fillers and additives. The quality of paper is mainly determined in the wire section of the paper machine. For instance, formation, i.e. small-scale variation of the basis weight of paper, distribution of fines and fillers and fibre orientation are largely determined in the wire section. As productivity demands become greater, speeds of paper machines have become considerably higher in the last years. The maximum design speeds are clearly above 2000 m/min today, whereas they were approximately 1700 m/min ten years ago. As the speed becomes higher, the water amounts grow and more water than before needs to be removed in a short section. In the latest former structures, drainage is made more efficient by means of a forming shoe and loading foils. This also makes new and greater demands on paper machine fabrics. The drainage must happen as evenly as possible in the fabric to minimize wire markings. Marking has, in fact, become one of the most important criteria in the selection of a fabric structure, because marking has a great effect on the printing qualities of paper. Markings may be divided into two types: topography markings and drainage markings. In topography marking, the surface of the paper side of the fabric is copied into a wet web. In drainage marking, fines and paper fibres are distributed unevenly in the paper structure in the xy direction, which causes an uneven formation. The drainage marking depends on drainage channels of the fabric structure. If the weave structure forms regularly spaced openings with differing sizes, such as diagonal lines, in the fabric, this pattern will also appear in the paper to be formed with the fabric. It is therefore important that the openings on the paper-side surface of the fabric are of the same size, and equally important is also that the drainage openings on the machine side are of the same size.

Double layer paper machine fabric structures, i.e. double layer wires, are generally known in the field. These structures comprise one warp system and two weft systems. The technique of a double layer paper machine fabric is described in U.S. Pat. No. 4,041,989, for example. Due to the one-weft system these wires are thin, but also apt to breaking. Since the drainage elements of the paper machine wear the fabric on the machine side, all yarns in the warp direction also wear, wherefore the risk of breaking the fabric becomes higher. In addition, the yarn wear makes the fabric unstable, which deteriorates the paper profiles.

Conventional triple layer paper machine fabrics comprise two separate layers: a paper side layer and a machine side layer, and the layers are interconnected mainly by means of a binder weft. Binding with a binder weft usually takes place at every fourth top and bottom yarn pairs. On the paper side, the binding takes place over one top warp and on the machine side, under one bottom warp. The binder weft does not contribute to the forming of the paper side surface, but only to the binding of the layers. The binder weft causes an extra yarn flow in the structure at the point of binding. At this point, the fabric is denser and water draining from the paper web cannot evenly exit through the wire, which causes marking. A triple layer structure is described in GB Patent 2 022 638.

Furthermore, paper machine fabrics, in which binder yarns binding the paper side layer and the machine side layer together also contribute to the forming of the paper side layer, are known in the field. Such structures are known as SSB structures. SSB is an abbreviation for sheet support binding. The technique of SSB structures is described, for instance, in U.S. Pat. No. 4,501,303, which also discloses a structure bound with a warp, U.S. Pat. Nos. 5,967,195 and 5,826,627. Due to the two warp structures, SSB and triple layer structures achieve a higher wear resistance and a better stability compared to double layer structures.

In SSB structures, the top weft positioned on both sides of the intersection of the binder yarns presses the top warp yarns at the intersection downwards and, simultaneously, both yarns of the binder yarn pair descend into the fabric, not supporting the top warp yarns from below. Consequently, the intersections remain on a lower plane than the surface of the wire, which may cause marking. This is disclosed in U.S. Pat. No. 5,967,195, for instance.

In both SSB and triple layer structures there occurs innerside wear. Innerside wear occurs when the layers of the paper side and the machine side are not interconnected sufficiently firmly and the layers abrade against each other. In SSB structures innerside wear occurs particularly at the intersections of the binder yarns. As a result of reciprocal motion of the paper side and machine side, the weft or warp yarns above and below the intersection of the binder yarns wear. The wear causes that the overlap of the layers alters in the warp direction and the permeability of the paper machine fabric becomes considerably poorer. Different parts may have worn differently, and thus the overlap may vary in the machine width, which causes profile problems in the paper.

Edge curvatures of a paper machine fabric constitute a problem in paper machines. Edge curvatures are caused by differences in tightness and structure between the paper side and the machine side. A tighter-woven layer or a layer that is considerably tighter than another layer tends to bend the fabric towards it. In structures with e.g. a two-shed paper side and a five-shed machine side, the paper side tends to lift the edges upwards. As the edges rise up, a suction area at the edges steals air and the paper web does not dry, which means that the web is too wet when it runs to the press section, which causes more breaks in the paper machine. In the worst case, the edges may rise so high that the pulp at the edge section of the web cannot be distributed evenly, and profile faults occur in these areas. The rising of the edges also harms the edge cutting.

As the speed becomes higher, fabrics become tighter. The greater tightness poses new challenges to the fabric. One of the most important demands on the fabric is stability. Fabric stability refers to the dimensional stability of the fabric. An example of poor stability is a large narrowing of the fabric when the fabric is tightened or the oblique running of the fabric, if the rolls of the paper machine are not entirely straight. In modern SSB structures, the binding point of the machine side of the binder yarn is not locked in its place, and thus the binder yarn can move with the bound yarn and the stability remains at a low level. As the fabric wears, the stability gets weaker.

It is an object of the invention to provide a paper machine fabric, by which prior art disadvantages can be eliminated. This is achieved by means of a paper machine fabric according to the invention. The paper machine fabric of the invention comprises at least four warp yarn systems and at least two weft yarn systems. The yarn systems in the weft direction are inter-woven by means of binder wefts or binder weft pairs. The invention is characterized in that warp yarns of one warp yarn system, i.e. wandering warps, are arranged to complement a warp path formed by the binder warps so that it is continuous at those points on the machine side where the binder warps constitute a part of the paper side structure, and are further arranged to run between the layers forming the paper side and the machine side at points where the binder warp binds the layers forming the paper side and the machine side together on the machine side.

A structure of the invention provides the advantage of balance. The most balanced structure is constituted by two-shed paper and machine sides. When both the paper side and especially the machine side are two-shed structures, no disturbing diagonal lines are formed. The warp path of the machine side is not only constituted by the binder yarns but also by a wandering warp, which complements the warp path to a two-shed structure. The machine side becomes smooth and even. The paper side becomes even when the wandering warp lifts up the intersection of the binder yarns on the paper side, whereupon the yarn on top of the intersection remains at the same level as the rest of the fabric.

In the structure of the invention, the wandering warp serves as a factor stabilizing the structure. The wandering warp locks the binding point of the binder weft on the machine side so that the binder warp and the warp yarn to be bound cannot move. The moving is prevented in both the longitudinal and the cross direction. Because of the wandering warp, there are many binding points on the machine side, whereby the pressure between the machine side of the paper machine fabric and the drainage equipment of the paper machine and wearing the fabric is distributed evenly along the entire fabric area. Consequently, the pressure of an individual point which contacts the drainage elements is lower than in conventional structures, and the wear of the paper machine fabric becomes slower. Two separate yarn systems of the machine side also ensure that the fabric does not break during the run and improve the stability of the fabric. The four-warp system and a great number of binding points make the paper machine fabric stable and provide it with a good diagonal stability.

In a structure of the invention, innerside wear is eliminated by means of a wandering warp and a dense binding. The wandering warp locks the intersection of the binder yarns so that the binder warps cannot move on the machine side of the fabric and the paper side yarn at the intersection cannot descend downwards and thus abrade against the binder yarns.

The four-warp system may affect the fact how the weft yarns in different layers are set with respect to each other. By adjusting the differences in tightness, the overlap of the wefts is brought to a desired level. The degree of overlap is referred to as stacking. When the weft yarns overlap, stacking equals 0 to 70, water must divide, whereby the removal of initial water does not happen abruptly. This kind of dense structure is suitable for use, for instance, as a bottom wire for hybrid formers. A hybrid former comprises, first, a fourdrinier wire section draining water in the downward direction and, thereafter, a top wire section, in the area of which a pulp web runs between two wires and water exits mainly in the upward direction. In order to remove water on the top wire, the web must contain a certain amount of water when it comes to the top wire section. When the yarns are on top of each other, i.e. the stacking equals 70 to 100, the removal of initial water is intensive. Such a wet wire is suitable for use in gap formers in order not to block the fabric. In a gap former, water is removed from the pulp web in a short section through both wires. In this case, the water has to be removed efficiently right from the start. The removal of initial water may be affected by means of weft yarn overlap, i.e. stacking. This property provides the paper web with the same paper fibre support, but the drainage speed may be adjusted.

A structure of the invention is thin, because it may use thin yarns in both the warp direction and the weft direction, and the warp yarn flows of the machine side are short when a two-shed structure is used. Splashing may occur in a paper machine at the point where the top wire turns to the return cycle. In the worst case the splashing decreases the quality of the paper web. An advantage of a thin structure is a small void volume, which in the case of a paper machine means a weak water transport and less splashing. A thin structure is also beneficial in the edge trimming of the paper web. It is easier for the edge trim squirt to push the fibres through the thin fabric, whereupon the edge trimming is more likely to succeed and there are fewer breaks. Dry matter is also dependent on the wire thickness—a thinner wire achieves a better dry matter level.

The structure of the invention is flexible in the machine direction, which advances the efficient operation of loading foils in the latest former structures, whereupon drainage becomes more effective and paper formation improves.

In the structure of the invention, the number of contact points on the paper side is great. This kind of structure provides the paper fibre with a good fibre support. Thus, paper retention improves and marking decreases.

The structure of the invention employs the same or almost the same shed structure on both the paper side and the machine side, and thus when the paper machine fabric is tightened by means of the paper machine, the layers act identically and there are no edge curvatures.

In a second structure of the invention, the machine side is a three-shed structure. Compared to a double layer structure, the weft loops on the machine side are longer in a three-shed structure, which improves wearability. The shed value of a three-shed machine side is, however, close to that of a two-shed structure, and thus no edge curvatures exist.

In a third structure of the invention, the paper side and the machine side are two-shed structures, but there are twice as many top wefts as bottom wefts, i.e. the weft ratio is 2:1. Due to such a structure, the surface is dense. A structure with a dense surface provides the fibre with a good support and thus allows a good and high retention. Retention refers to the ratio of the amount of paper fibres and fillers remaining on the wire to the amount of fed matter in percents. For example, if all paper fibres and fillers remain on the paper machine fabric, the retention is 100%, and if half of the paper fibres and fillers remain on the paper machine fabric, the retention is 50%.

In a structure of the invention, a similar binder yarn solution is used as in U.S. Pat. No. 6,354,335. The structure of the publication comprises a substitute warp, on both sides of which there is a binder warp, and the substitute warp is arranged to complement the two warp paths formed by the above-mentioned two binder warps on the paper side at the points where the above-mentioned two binder warps are woven into the machine side. In one of such structures according to the invention, there are five warp systems: top, bottom, binder, wandering and substitute warp system.

Figure 2:
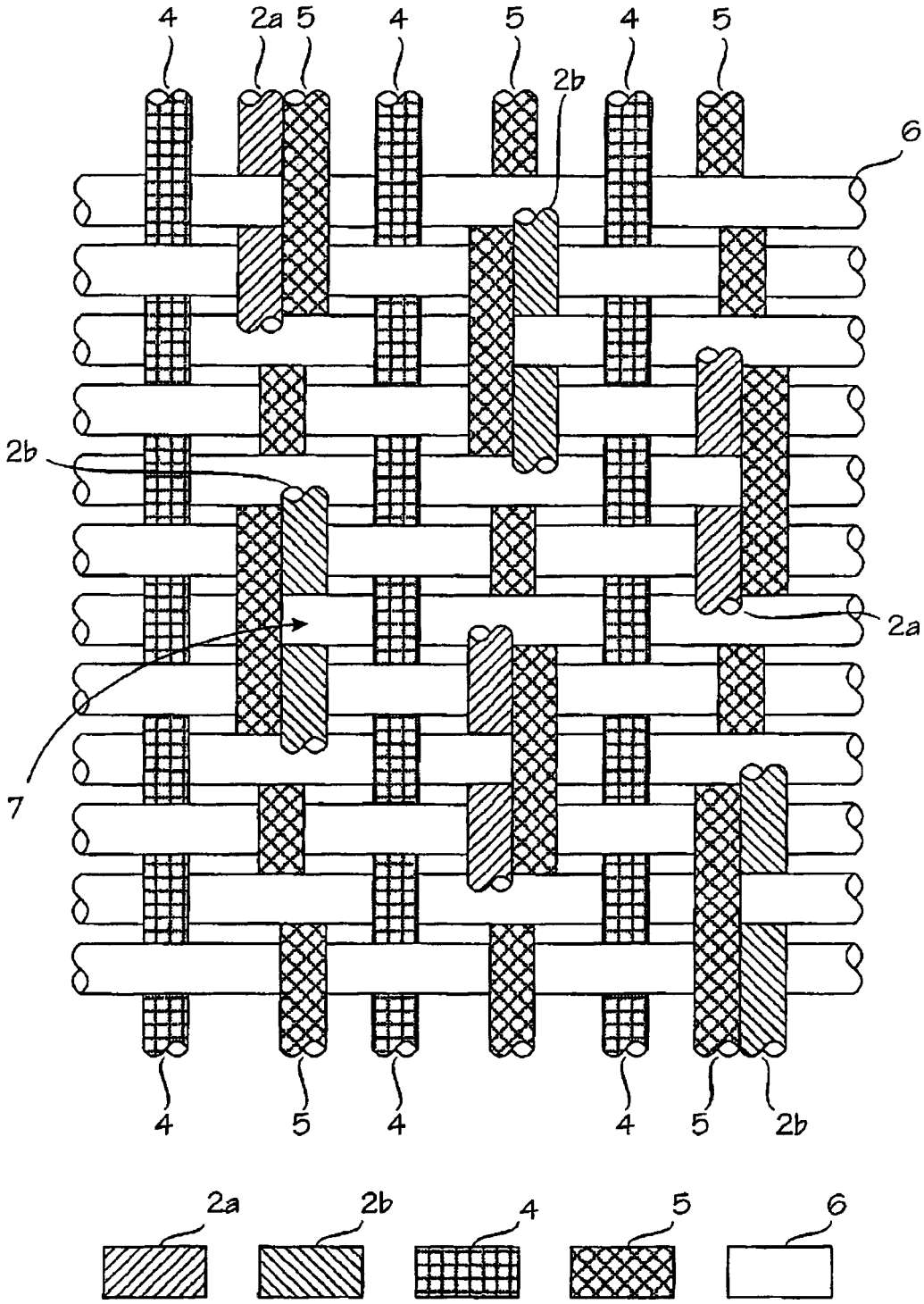

The invention will now be described in greater detail by means of examples illustrated in the attached drawing, in which FIG. 1 shows a paper machine fabric of the invention from the paper side, FIG. 2 shows a machine side of the paper machine fabric of the invention from the top, FIGS. 3A to 3E show cross-sectional views of the paper machine fabric of the invention, FIGS. 4A to 4E show cross-sectional views of a second paper machine fabric of the invention, FIGS. 5A to 5E show cross-sectional views of a third paper machine fabric of the invention.

Figure 3:
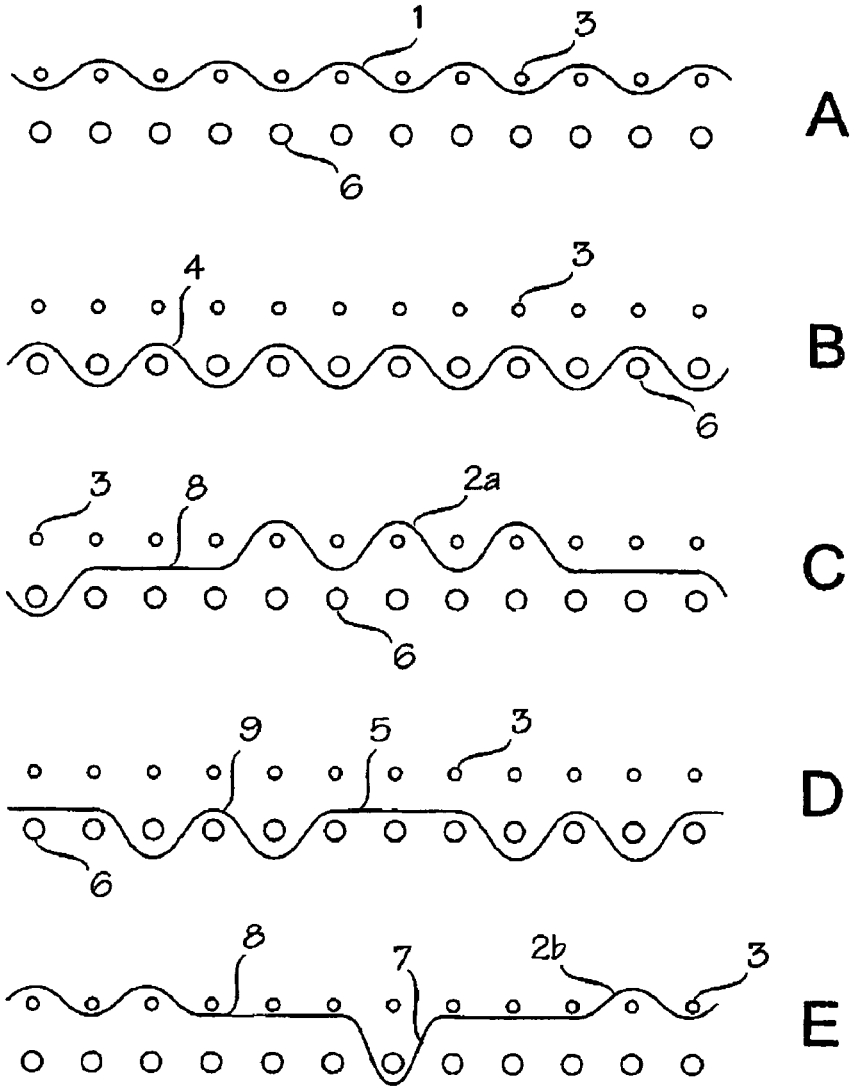
Figure 4:
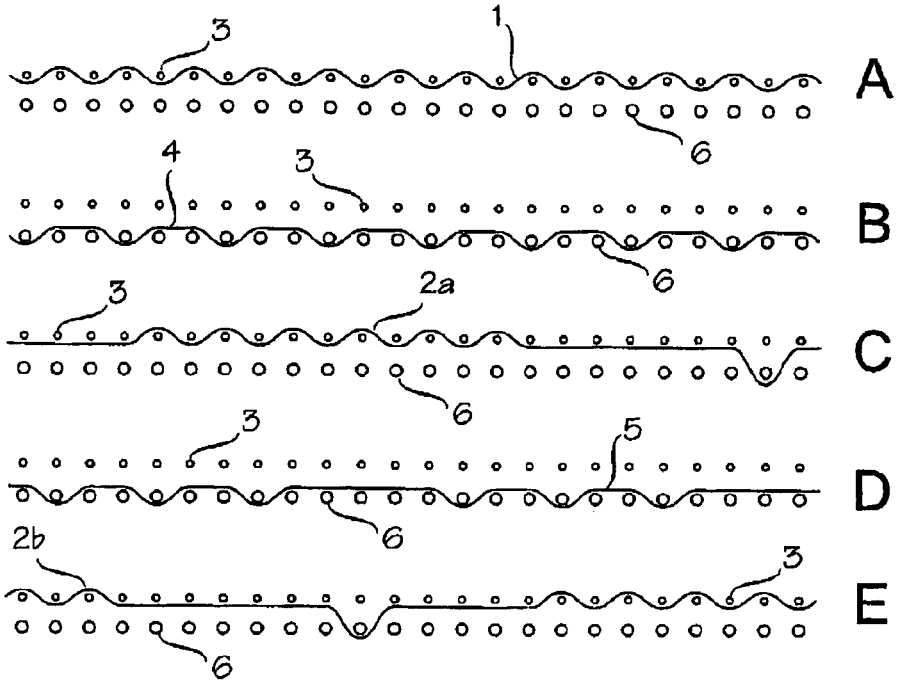
Figure 5:
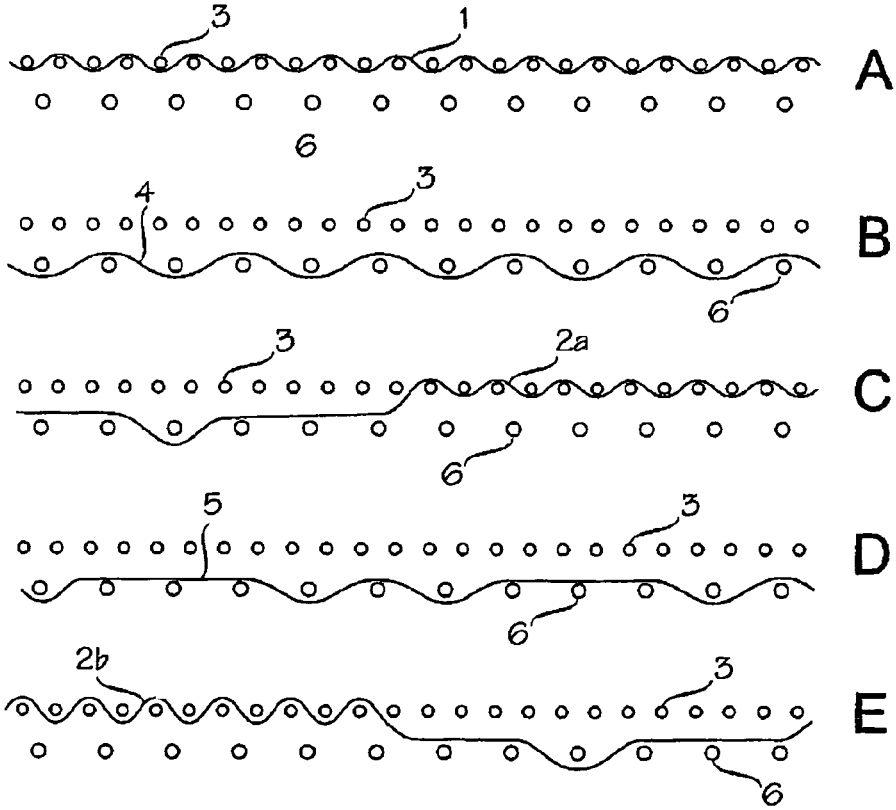

A paper machine fabric of the invention with a four-warp system and a wandering warp is shown in FIGS. 1 to 3. FIG. 1 shows the paper side of the paper machine fabric. FIG. 2 shows the machine side of the paper machine fabric from the top, in other words the paper side yarns have been removed from the paper machine fabric. FIGS. 3A to 3E show four different warp paths of the paper machine fabric. It can be seen from FIG. 1 that the layer of the paper side is made of top warps which are wound into top wefts. The top warps are denoted by the reference numeral 1 and the top wefts by the reference numeral 3. The paper side further comprises binder warp pairs which are woven into the top wefts, thus forming a continuous warp path on the paper side. The binder warps are denoted by the reference numerals 2*a* and 2*b*.

FIG. 1 shows that the top warps 1 and the binder warp pairs 2*a*, 2*b* are woven into the top wefts as two-shed plain weave, i.e. on the paper side, each top weft yarn alternately passes over one warp yarn and under the next warp yarn.

FIG. 2 shows the machine side of the paper machine fabric. The pattern repeat of the machine side is formed by three bottom warps, which are woven into the bottom wefts. The bottom warps are denoted by the reference numeral 4 and the bottom wefts by the reference numeral 6. The machine side further comprises binder warp pairs 2*a*, 2*b*, which, together with a wandering warp, form continuous warp paths on the machine side. The wandering warp is denoted by the reference numeral 5. In FIG. 2, the gaps between the warp and binder yarns are made large in order to see the travel path of yarn better. In reality, the binder warps 2*a*, 2*b* and the wandering warp 5 are positioned one on top of the other or approximately on top of one another, as a result of which drainage openings of equal size are provided on the machine side. In this manner, a steady drainage is achieved and there is no undesired drainage marking.

FIG. 2 shows that the bottom warps 4 and the warp path made of the binder warp pair 2*a*, 2*b* and the wandering warp 5 form together with the bottom wefts a two-shed plain weave on the machine side, which means that each bottom weft yarn alternately first passes over and then under the next warp yarn on the machine side. Since both the paper side and the machine side are two-shed structures, the fabric does not have inner tensions, and thus the structure does not comprise edge curvatures. It can be seen from FIG. 2 that at the point where the binder warp 2*a*, 2*b* binds the weft yarn 6 on the machine side, the wandering warp 5 locks the binding point in such a manner that the binder warp 2*a*, 2*b* and the weft yarn 6 to be woven cannot move in the longitudinal or the cross direction. The binding point is denoted by the reference numeral 7.

FIGS. 3A to 3E illustrate the travel path of all four warp yarns to be woven in different manners. FIG. 3A shows a top warp yarn 1. The top warp yarn 1 is woven to top wefts 3 only. FIG. 3B shows a bottom warp yarn 4, which is situated under the top warp 1 in the paper machine fabric. The bottom warp yarn 4 is woven to bottom wefts 6 only. FIGS. 3C and 3E show the travel path of the binder warps 2*a*, 2*b*. When the binder warps 2*a*, 2*b* are woven on the paper side, they form a two-shed plain weave similarly as the top warps. The binder warp binds at least one bottom weft yarn 6 on the machine side. In FIGS. 3C and 3E, the intersections are denoted by the reference numeral 8. FIG. 3D shows the travel path of the wandering warp 5. Like the bottom warp 4, the wandering warp 5 is interwoven with the bottom wefts 6 only. At the points where the binder warp 2*a*, 2*b* binds the layers of the paper side and the machine side together, the wandering warp 5 passes between the paper side and the machine side. FIGS. 3C to 3E show how the wandering warp 5 forms a bend between the paper side and the machine side and lifts the intersection 8 of the binder warps 2*a*, 2*b*, whereupon the top weft cannot descend lower than the adjacent top wefts and the paper side thus becomes even. The bend of the wandering warp, lifting the top weft, is denoted by the reference numeral 9.

In the attached table, a preferred structure of the invention, a double layer wire structure and a 1:1 SSB structure are compared. Due to SSB structures, not only permeability but also an open area of the paper side play an important role in selecting wires for a paper machine. The open area expresses the percentage of the paper side openings on the entire area of the paper side. An open surface area cannot be determined for double layer structures. The SSB wire to be compared is selected in such a manner that it has the same open area, and the reference double layer wire is run with the same machine as the reference SSB wire.

| CHARACTERISTIC | A structure of the invention | Conventional double layer wire | 1:1 SSB structure |
|---|---|---|---|
| MD YARNS: Ø/density | | | |
| Top warp (mm/l/cm) | 0.13/16 | 0.15/73 | 0.12/34 |
| Binder warp (mm/l/cm) | 0.13/16 | — | — |
| Wandering warp/ mm/l/cm) | 0.13/16 | — | — |
| Bottom warp (mm/l/cm) | 0.13/16 | — | 0.18/34 |
| CMD YARNS: Ø/density | | | |
| Top weft (mm/l/cm) | 0.11/38 | 0.15/30 | 0.12/22 |
| Binder weft (mm/l/cm) | — | — | 0.12/11 |
| Bottom weft (mm/l/cm) | 0.18/38 | 0.18/30 | 0.19/33 |
| MD yarn density (l/cm) | 62 | 73 | 69 |
| CMD yarn density (l/cm) | 75 | 61 | 66 |
| T figure | 138 | 134 | 135 |
| S figure | 69 | — | 68 |
| SP figure | 1173 | 555 | 1139 |
| Open area (%) | 35 | — | 35 |
| Permeability ($m^3/m^2h$) | 4500 | 4700 | 5400 |
| Wear margin (mm) | 0.13 | 0.15 | 0.18 |
| Thickness (mm) | 0.57 | 0.56 | 0.67 |
| Void volume ($ml/m^2$) | 334 | 285 | 372 |
| Stability 60N (%) | 1.88 | 3.02 | 2.28 |
| Paper-side weave | plain weave | 8-shed | plain weave |
| Machine-side weave | plain weave | | 5-shed |

In a paper machine, paper fibres are orientated in the machine direction. It is therefore important that fabric structure has enough transversal weft yarns on the paper side, because they provide the fibres orientated in the warp direction with a better support. At the same time, it should be considered that the open area of the paper side remains sufficiently large to ensure the drainage capacity. In the structure of the invention the open surface is the same as in the SSB structure to be compared, and the number of weft yarns on the paper side is 16% higher. The structure of the invention achieves a better fibre support (SP figure) than the wire structures to be compared. A good fibre support is an essential factor in achieving unmarked paper. The structure according to the invention is as thin as a double layer wire structure. The best dry matter has conventionally been achieved with thin fabrics. Although the structure of the invention is thin, its stability is clearly better than in the structures used today. One way to measure the firmness of the fabric is to measure its stability. Stability expresses how great the displacement between the longitudinal and transversal yarns is under a particular load. The smaller the displacement, the more stable the fabric. In the comparison, the stability of the structure of the invention is the lowest, i.e. the structure is the most stable, which helps to achieve even paper profiles. In addition, a stable paper machine fabric-runs straight in the paper machine and does not cause steering problems.

FIGS. 4A to 4E show a-second paper machine fabric of the invention as cross-sectional views in the warp direction. FIGS. 4A to 4E use the same reference numerals as FIGS. 1 to 3 to refer to the corresponding parts. In this application, the paper side is a two-shed structure and the machine side a three-shed structure. The shed value of the paper side and that of the machine side are still so close to one another that inner tensions can be controlled and no harmful edge curvatures are formed. It is also essential in this structure that the wandering warp supports the intersection of the binder warps. Compared to a double layer structure, a three-shed structure comprises longer weft loops on the machine side, which improves wearability.

FIGS. 5A to 5E show a third example of the paper machine fabric of the invention. In FIGS. 5A to 5E, the same reference numerals are used as in the examples of the previous figures to refer to the corresponding parts. The paper machine fabric is a 2:1 structure. The surface of the structure is dense, and thus the structure provides the fibre with a good support and enables a good and high retention.

Above-mentioned examples are not intended to restrict the invention in any way, but the invention may be modified freely within the scope of the claims. It is thus obvious that the paper machine fabric of the invention or the details thereof need not necessarily be exactly like those shown in the figures but that other solutions are possible as well. Separate layers may be formed quite freely, i.e. so that the number of yarn systems may vary; what is essential is that there are at least four warp systems, one of which is a wandering warp system. Accordingly, the number or weft systems may vary; it is essential that there are at least two weft systems: a top weft system and a bottom weft system, etc. In the structure of the invention, a binder weft system may be used together with the warp binding. The above-described structure of the invention has three layers but other multilayer structures are also feasible within the scope of the invention. Instead of a plain weave, other weaves, such as satin weaves or twill weaves, may be used on the surface of the paper side. The weaves of the bottom wefts and of the binder yarns may also vary freely within the scope of the basic idea of the invention. Furthermore, it is to be noted that in accordance with the basic idea of the invention it is possible to form structures which do not comprise a top warp at all, which means that there is provided a structure in which there are only binder and substitute warps on the paper side. On the other hand, it is perfectly possible to form structures in which the number of top warps is higher than the number of binder warp pairs. In other words, the number of top warps may vary and it may be, for instance, 0, 1, 2, 3, etc. The number of bottom warps may differ from the number of top warps and binder warp pairs altogether. The binder warps in the binder warp pair need not be interwoven in the same way, which means that the binder warps of the binder warp pair may have a similar warp travel path, but this application is not the only feasible solution, but the binder warps of the binder warp pair may also have differing warp travel paths. The top/bottom weft ratio may be 1:1 or 2:1, as in the previous solutions, but the weft ratio may also be 3:2, 4:3, etc. In all solutions described above, the number of top and bottom warps is the same, i.e. the warp ratio is 1:1, but the number of warps in different layers may vary, i.e. the warp ratio may also be 1:2, 2:1, etc. The solution of the invention works best when both the paper side and the machine side are two- or three-shed structures, but a good result is achieved when the shed values of both sides are close to one another, e.g. when a three-shed machine side is close to a two-shed structure of the paper side, a five-shed paper side is close to a six-shed machine side, etc. The object of the invention is a wet wire, but it may also be used in other positions of the paper machine, i.e. as a press felt or a drying wire or as another industrial fabric, such as a wire for forming a non-woven fabric.

The solutions described above use polyester and polyamide yarns with round cross-sections. Other feasible yarn materials include PEN (polyethylene naphthalate) and PPS (polyphenylene sulphide). Yarns may be "profile yarns", the cross-section of which is other than round, i.e. flat, oval or the like. Yarns may also be hollow, in which case they may flatten in the fabric, making the structure even thinner. Yarns may further be "bicomponent yarns". The selection of yarn characteristics may play a role in fabric characteristics, e.g. the structure is made thinner than before or the paper side surface is made more even. The size of warp diameters may vary. It is essential that top and bottom warps have equal thicknesses or almost equal thicknesses so that either the top warp or the bottom warp is thicker.

The invention claimed is:

1. A paper machine fabric having a paper side surface and a machine side surface, the paper machine fabric comprising at least two separate layers made of at least four warp yarn systems woven in different manners and at least two weft yarn systems woven in different manners, the layers being bound together by means of a binder warp system, whereby the binder warp forms a portion of the surface of the paper side and to be interwoven with the layer of the machine side by being interwoven under at least one weft yarn of the machine side, in which paper machine fabric warp yarns of one warp yarn system, i.e. wandering warps, form a portion of a warp path formed by the binder warps so that the warp path is continuous at those points on the machine side where the binder warps constitute a part of the paper side structure, and are further arranged to run between the layers forming the paper side and the machine side at points where the binder warp binds the layers forming the paper side and the machine side together on the machine side.

2. A paper machine fabric as claimed in claim 1, wherein the wandering warp is arranged to lift up the intersection of the binder warps.

3. A paper machine fabric as claimed in claim 1, wherein the wandering warp and the binder warps are interwoven with the wefts of the machine side at different stages.

4. A paper machine fabric as claimed in claim 1, wherein the fabric is a wet wire.

5. A paper machine fabric as claimed in claim 1, wherein the paper side and the machine side have the same or almost the same shed value.

6. A paper machine fabric as claimed in claim 1, wherein the diameter of all longitudinal yarns is equally long.

7. A paper machine fabric as claimed in claim 1, wherein the diameter of all longitudinal yarns is almost equally long.

8. A paper machine fabric as claimed in claim 1, wherein the weft yarns overlap, i.e. the stacking equals 0 to 70.

9. A paper machine fabric as claimed in claim 1, wherein the weft yarns are on top of one another, i.e. the stacking equals 70 to 100.

10. A paper machine fabric as claimed in claim 1, wherein the paper side and the machine side are two-shed structures.

11. A paper machine fabric as claimed in claim 1, wherein the paper side is a two-shed structure and the machine side is a three-shed structure.

12. A paper machine fabric as claimed in claim 1, wherein the weft ratio is 1:1.

13. A paper machine fabric as claimed in claim 1, wherein the paper machine fabric also comprises a substitute warp system, in which a substitute warp is positioned between the binder warps and forms a portion of the warp paths of the binder warps on the paper side at the points where the binder warps constitute a part of the structure of the machine side.

14. A paper machine fabric as claimed in claim 1, wherein it includes binder weft yarns, which contribute to the forming of the paper side surface.

15. A paper machine fabric as claimed in claim 1, wherein the binder warps have a similar warp travel path.

16. A paper machine fabric as claimed in claim 1, wherein the binder warps have differing warp travel paths.

* * * * *